US006216361B1

(12) United States Patent
Smith et al.

(10) Patent No.: US 6,216,361 B1
(45) Date of Patent: Apr. 17, 2001

(54) DEHYDRATION OF DRILLING MUD

(75) Inventors: Richard J. Smith; David Roger Jeanson, both of Calgary (CA)

(73) Assignee: Newpark Canada Inc. (CA)

( * ) Notice: Subject to any disclaimer, the term of this patent is extended or adjusted under 35 U.S.C. 154(b) by 0 days.

(21) Appl. No.: 09/451,885

(22) Filed: Dec. 1, 1999

(30) Foreign Application Priority Data

Nov. 17, 1999 (CA) ..... 2289964

(51) Int. Cl.[7] ..... F26B 3/00

(52) U.S. Cl. ..... 34/329; 34/381; 507/109; 507/145

(58) Field of Search ..... 34/329, 332, 334, 34/337, 338, 351, 381; 507/145, 109, 90

(56) References Cited

U.S. PATENT DOCUMENTS

| | | | | |
|---|---|---|---|---|
| 1,701,092 | | 2/1929 | Zoul . | |
| 2,316,967 | | 4/1943 | Miller | 257/8.5 |
| 2,856,154 | | 10/1958 | Weiss et al. | 255/1.8 |
| 3,878,110 | * | 4/1975 | Miller et al. | 252/8.5 B |
| 3,979,303 | * | 9/1976 | Kang et al. | 252/8.5 C |
| 4,451,377 | | 5/1984 | Luxemburg | 210/708 |
| 4,888,120 | * | 12/1989 | Mueller et al. | 252/8.551 |
| 6,076,278 | * | 6/2000 | Bradley | 34/329 |

FOREIGN PATENT DOCUMENTS 2175859 11/1997 (CA) .

OTHER PUBLICATIONS

Gray, George R. and Darley, H.C.H., "Composition and Properties of Oil Well Drilling Fluids," Gulf Publishing Company, Houston, Texas (Dec. 1948); pp. 576–577.

Rogers, Walter F., "Composition and Properties of Oil Well Drilling Fluids," Gulf Publishing Company, Houston, Texas (1953); p. 478.

* cited by examiner

*Primary Examiner*—Stephen Gravini
(74) *Attorney, Agent, or Firm*—Lerner, David, Littenberg, Krumholz & Mentlik, LLP

(57) ABSTRACT

There is provided an improved method for removing water from oil based drilling fluids used in the drilling of boreholes through the ground wherein $MgSO_4$ (magnesium sulfate) is added to the drilling fluid to scavenge the water therefrom.

16 Claims, No Drawings

DEHYDRATION OF DRILLING MUD

FIELD OF THE INVENTION

The present invention relates to drilling fluids and more particularly to the removal of water from oil based drilling fluids.

BACKGROUND OF THE INVENTION

When drilling boreholes through the earth, it is the normal practice to circulate a drilling fluid down the drill string, through the drill bit and then back up to the surface through the annulus between the drill string and the borehole wall. Drilling fluids perform a variety of functions and their characteristics, such as density, viscosity and chemical composition are carefully selected depending upon the functions to be performed, to avoid negative effects on the geological strata being penetrated and to maintain borehole integrity.

Continuous phase oil based drilling fluids are well known in the drilling industry and have been used successfully particularly when drilling through water sensitive formations such as certain types of clay-bearing shales that swell when contacted by fresh water. Ideally therefore, the drilling fluid should be maintained as a pure oil but in practice, water contamination of the oil is almost inevitable. Water can enter the system either from the surface (rain etc.) or, more typically, by ingress of formation water present in some of the strata penetrated by the bore. Typically, the drilling fluid is continuously monitored at the surface for water content using two tests, namely electrical stability to detect the physical presence of water if drilling with a non-viscosified pure oil, and/or distillation of a carefully measured sample of the fluid in a retort or still to determine the actual amount of water present in the fluid. Using the electrical stability test, if the fluid sample remains non-conductive up to an applied potential of 2000 volts, the fluid is considered to be water free. This test cannot however be used with a viscosified oil as the viscosifiers can emulsify the water and mask its presence. If the electrical potential at which the fluid becomes conductive drops below 2000 volts, or if a stability test is not possible and the presence of water is to be detected, the sample is placed in the retort and the free water is essentially boiled off and its volume is then compared to the volume of the oil itself which is boiled off at a higher temperature to separate it from any entrained solids in the sample.

If free water is detected, the usual practice has then been to attempt to neutralize the water by emulsifying it to form an internal discontinuous phase of small droplets within the oil based fluid. This is done by the addition of emulsifiers, surfactants and oil wetting agents to create an invert oil emulsion, as is well known in the art.

The presence of emulsified water in the oil still has negative effects, not the least of which can be excessive increases in the drilling fluid's viscosity that robs considerable efficiency from drilling operations. The water itself, particularly if fresh, is in ionic imbalance with usually saline formation water and must therefore be salinated, usually with calcium chloride ($CaCl_2$). The presence of chloride ions in the drilling fluid adds considerably to the cost of treating and disposing of the drill cuttings.

In some instances, free water is added to an oil based drilling fluid deliberately. This might be done to raise the fluid's viscosity or to decrease filtrate loss to formation. Whether water is added deliberately or not, the drilling fluid must still be emulsified and salinated. The deliberate addition of water reflected the heretofore near inevitability of having to create an invert emulsion in any event. The present invention eliminates or at least reduces this inevitability and the characteristics sought to be obtained by the deliberate addition of water can now be obtained in other practical ways. For example, viscosity increases can be obtained by adding organophyllic clays. Fluid loss control can be regulated by the addition of, for example, gilsonite, calcium carbonate or cellulose fiber. If the fluid must be weighted up to offset formation pressures, additives such as barite can be introduced.

There are therefore considerable operation and cost advantages to drilling with a pure oil system and being able to avoid having to convert the system to an invert emulsion. The applicant has found that this is possible, or at least the conversion to an invert emulsion can be delayed, by scavenging the water from the drilling fluid on a continuous basis while drilling.

SUMMARY OF THE INVENTION

To scavenge the water from the drilling system, anhydrous magnesium sulfate is added to the drilling fluid. Water is removed according to the following chemical reaction:

$$MgSO_4+7H_2O \rightarrow MgSO_4 \cdot 7H_2O$$

Water reacts with the magnesium sulfate, precipitating magnesium sulfate heptahydrate, typically in balls or clumps.

Based on this reaction, and using the known molecular weights of $MgSO_4$ and water, it can be calculated that approximately one kilogram of magnesium sulfate is required to scavenge one liter of water. In practice, it has been found that an excess of up to approximately 50% of $MgSO_4$ is desirable for the reaction, which is exothermic, to go quickly to completion. Accordingly, approximately 1.50 kilograms of $MgSO_4$ are added to remove one liter of water.

According to the present invention, then, there is provided a method of removing water from oil-based drilling fluids used in the drilling of boreholes in the earth, comprising the step of adding $MgSO_4$ (magnesium sulfate) to said drilling fluid to remove the water therefrom.

According to a further aspect of the present invention there is also provided a method of removing free water from a hydrocarbon based drilling fluid used in the drilling of boreholes through the ground, comprising the steps of calculating the amount of water in the drilling fluid; and adding $MgSO_4$ (magnesium sulfate) to the drilling fluid to remove the water in accordance with the following formula: $MgSO_4+7H_2O \rightarrow MgSO_4 \cdot 7H_2O$, where: $MgSO_4$ is magnesium sulfate, $H_2O$ is water and $MgSO_4 \cdot 7H_2O$ is magnesium sulfate heptahydrate.

According to yet another aspect of the present invention, there is provided a method for testing for the presence of free water in a hydrocarbon based drilling fluid to which $MgSO_4$ (magnesium sulfate) has been added to scavenge water therefrom, comprising the steps of sampling a predetermined volume of said drilling fluid for heating in retort means; and elevating the temperature of said sample to a temperature above the boiling point of water and below the melting point of $MgSO_4 \cdot 7H_2O$ (magnesium sulfate heptahydrate) for a sufficient amount of time to boil off said water and collect the same.

According to yet another aspect of the present invention, there is provided a method of calculating the concentration of water in a hydrocarbon based drilling fluid to which $MgSO_4$ (magnesium sulfate) has been previously added to scavenge water therefrom, comprising the steps of collecting a predetermined volume of said drilling fluid for heating in retort means; elevating the temperature of said sample to a temperature above the boiling point of water and below the melting point of $MgSO_4 \cdot 7H_2O$ (magnesium sulfate heptahydrate) for a sufficient amount of time to boil off and collect said water; elevating the temperature of the remaining sample to above the boiling of said hydrocarbon based fluid and collecting any additionally released water and boiled off hydrocarbon; and calculating the concentration of said water in said drilling fluid by comparing the amount of boiled off water collected to the amount of boiled off hydrocarbon collected.

EXAMPLE

Retort analysis indicates a water concentration in the drilling fluid of 1 kilogram per cubic meter. There are 500 cubic meters of drilling fluid in the system for a total of 500 kilograms of water. The amount of $MgSO_4$ required to remove this amount of water is 500×1.50=750 kilograms, based on an approximate 50% excess over the theoretical amount. As a rule of thumb, 15 kilograms per cubic meter of $MgSO_4$ is added for each 1% of water in the system.

When testing for free water in $MgSO_4$-treated drilling fluid, it is important to realize that the product formed by the reaction, $MgSO_4 \cdot 7H_2O$, magnesium sulfate heptahydrate, has a melting temperature of only 150° C. (302° F.).

As mentioned above, the normal method of testing for free water in the drilling fluid is first of all to boil off the water and to record its volume and then to boil off the oil at approximately 950° F. to record its volume for comparison to that of the water. Boiling off the two fluid phases in the sample leaves behind the solids so that their weight is eliminated from the calculation.

However, if the oil treated with $MgSO_4$ is similarly heated to anything over 150° C., the magnesium sulfate heptahydrate begins melting to release scavenged water and the results will therefore be misleading. Accordingly, to obtain an accurate measurement of free water, one of two methods may be used.

The first is to remove the solids fraction, including the reacted magnesium sulfate heptahydrate, prior to heating using, for example, a 200 mesh screen. The weight of the remaining solids will therefore be relatively insignificant as a percentage by weight of the sample which is then retorted at 260° F. for approximately 45 minutes to boil off any free water. The volume of this water can then be compared to the volume of the remaining oil to calculate the amount of free water present in the system.

The second method can be used if pre-screening solids is not possible or practicable. In this method, the sample including both fluid and solid phases is retorted initially to 260° F. for approximately 45 minutes to boil off and collect any free water. The remaining sample is then gradually heated to approximately 950° F. Any additional water collected during the heating will be effectively ignored as the result of melting the $MgSO_4 \cdot 7H_2O$, leaving the volume of oil to then be compared to the volume of free water in order to calculate the oil-water ratio.

Although 45 minutes has been found to be a suitable amount of time to heat the sample to release free water, this figure is not limiting and may vary considerably up or down depending upon sample size, water concentration, retort temperature and so forth. Experience with the method and sample sizes used will ultimately yield the most appropriate times for good results. For the size of samples normally taken in the field for retort analysis, one or two hours should be required at most.

Typically, oil based drilling fluids contain a number of additives to control their viscosity (e.g. organophyllic clays) fluid loss control (gilsonite), and other additives such as calcium carbonate, cellulose fibers, barite and oil wetting agents. Other scavengers might be present as well such as those used commercially for hydrogen sulfide protection. In testing, magnesium sulfate in a 50% excess over theoretical has proven effective in quickly scavenging water in such systems. Having the excess additionally allows the system to react to and scavenge new water entering the system even before the next round of testing.

Example 1. 200 ml of diesel fuel was added to a 250 ml erlenmeyer flask.

2. Electrical Stability was measured using an O.F.I. Electrical Stability Meter. Three measurements were made and then averaged as reported in Table 1.

3. 2% (or 4 ml) of fresh water was added to the diesel sample and stirred with a magnetic stirrer for 10 minutes. Three E.S. readings were taken for the water contaminated sample with the sample stirred briefly between measurements and measurements taken immediately after the stir plate was turned-off.

4. A calculated amount of Magnesium Sulfate ($mgSO_4$) was added to the water contaminated sample. Samples again were mixed with a magnetic stirrer. The following summarizes the stoichiometric calculation used to determine additions.

g $MgSO_4$=120.36/18.02×1/7×# g water (with $MgsO_4 \cdot 7H_2O$ being formed)

5. Electrical Stability readings were determined for each of the treated samples in 5 minute intervals. Again three readings were taken and then averaged before reporting, with brief mixing between measurements. If E.S. readings were low, additional scavenger was added.

6. Concentrations of products added, mixing intervals and the E.S. readings are reported in Table 1.

7. A 1 L sample of viscosified oil was prepared with an Osterizer blender. The additives included; diesel 1 L, Oilgel 3000 10 kg/m$^3$, OMV-100 10 kg/m$^3$, and Gilsonite HT 10 kg/m$^3$. The viscosity was found to decrease after the Gilsonite was added so an additional 10 kg/m$^3$ Oilgel was added. Five minutes mixing time was given between product additions and 15 minutes mixing after the last addition. Note: all samples were allowed to cool to room temperature before testing.

8. The above sample was tested for rheology and A.P.I. fluid loss.

9. 3% water was then added and the % water determined with a Fann 50 ml variable temperature mud still. A setting of 60% was determined the point where water was distilled. Properties are reported in Table 2. Note: sample was "too thick" to determine rheology, etc.

10. To 50 ml of the viscosified fluid in #7, 21.7 g of Magnesium Sulfate was added (50% excess of theoretical). The sample was mixed for 10 minutes using a Hamilton Beach. Properties are reported in Table 2. After the addition of the $MgSO_4$, 1 L/m$^3$ Chemwet-OM was added to lower the rheology.

11. To the sample in #10 (pretreated with scavenger), 3% water was added and mixed on the Hamilton Beach for 10 minutes. In order to properly test the sample, small amounts of Chemwet-OM was added to lower the rheology. Required concentration of Chemwet-OM are reported. Properties were determined and reported in Table 2.

TABLE 1

Averaged Electrical Stability Measurements

| Sample | material addition comments | E.S. (V) 5 min. | E.S. (V) 10 min. | E.S. (V) 15 min. | E.S. (V) 20 min | temp. ° C. |
|---|---|---|---|---|---|---|
| w/2% water | | 452 | | | | 22.5 |
| w/3.82 g $MgSO_4$ | theoretical | 2000 | 2000 | 1139 | 2000 | 28 |
| w/5.73 g $MgSO_4$ | 50% excess | 2000 | 2000 | 2000 | 2000 | 29 |

TABLE 2

Viscosified Oil Analysis with Magnesium Sulfate and Calcium Oxide

| Properties | base | 3% water | base w/ $MgSO_4$ | base w/ $MgSO_4$ + 3% water |
|---|---|---|---|---|
| Chemwet-OM | | | | 2 L/m$^3$ |
| 600 | 14 | | 46 | 23 |
| 300 | 15 | | 38 | 14 |
| 200 | 13 | | 33 | 10 |
| 100 | 9.5 | | 30 | 6.5 |
| 6 | 8 | | 29 | 3 |
| 3 | 7 | | 28 | 2 |
| PV (mpa·s) | 9 | | 8 | 9 |
| YP(Pa.) | 3 | | 15 | 2.5 |
| Gel (10 sec.) | 5 | | 12 | 1.5 |
| Gel (l0 min.) | 7 | | 13 | 4.5 |
| Filtrate (ml) | 14.6 | | 19 | 16.6 |
| A.P.I. | | | | |
| temp. ° C. | 22 | | | 38 |
| % water retort | 0 | 1% | | 0 |

Solids removal, including the removal of the magnesium sulfate heptahydrate, from the drilling fluid is completed conventionally using one or more of the known techniques in the art including screening, centrifuging and settling.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

The embodiments of the invention in which an exclusive property or privelege is claimed are defined as follows:

1. A method of removing water from oil-based drilling fluid used in the drilling of boreholes in the earth, comprising the step of adding $MgSO_4$ (magnesium sulfate) to said drilling fluid to remove the water therefrom.

2. The method of claim 1 wherein the concentration of water in said drilling fluid is calculated and magnesium sulfate is added to said drilling fluid in an amount based on said calculation.

3. The method of claim 2 wherein said amount is about 1 kilogram of magnesium sulfate per kilogram of water to be removed.

4. The method of claim 2 wherein said amount is about 1.5 kilograms of magnesium sulfate per kilogram of water to be removed.

5. The method of claim 1 wherein water is removed from the drilling fluid according to the following chemical reaction:

$$MgSO_4+7H_2O \rightarrow MgSO_4 \cdot 7H_2O$$

where:

$MgSO_4$ is magnesium sulfate $H_2O$ is water $MgSO_4 \cdot 7H_2O$ is magnesium sulfate heptahydrate.

6. A method of removing free water from a hydrocarbon based drilling fluid used in the drilling of boreholes through the ground, comprising the steps of:

calculating the amount of water in the drilling fluid; and adding $MgSO_4$ (magnesium sulfate) to the drilling fluid to remove the water in accordance with the following formula:

$$MgSO_4+7H_2O \rightarrow MgSO_4 \cdot 7H_2O$$

where:

$MgSO_4$ is magnesium sulfate $H_2O$ is water $MgSO_4 \cdot 7H_2O$ is magnesium sulfate heptahydrate.

7. A method for testing for the presence of free water in a hydrocarbon based drilling fluid to which $MgSO_4$ (magnesium sulfate) has been added to scavenge water therefrom, comprising the steps of:

sampling a predetermined volume of said drilling fluid for heating in retort means; and elevating the temperature of said sample to a temperature above the boiling point of water and below the melting point of $MgSO_4 \cdot 7H_2O$ (magnesium sulfate heptahydrate) for a sufficient amount of time to boil off said water and collect the same.

8. The method of claim 7 wherein the temperature below said melting point of $MgSO_4 \cdot 7H_2O$ is below substantially 150° C.

9. The method of claim 8 wherein said amount of time is up to substantially two hours.

10. The method of claim 9 wherein said amount of time is substantially 30 to 75 minutes.

11. The method of claim 10 wherein said amount of time is substantially 45 minutes.

12. A method of calculating the concentration of water in a hydrocarbon based drilling fluid to which $MgSO_4$ (magnesium sulfate) has been previously added to scavenge water therefrom, comprising the steps of:

collecting a predetermined volume of said drilling fluid for heating in retort means;

elevating the temperature of said sample to a temperature above the boiling point of water and below the melting point of $MgSO_4 \cdot 7H_2O$ (magnesium sulfate heptahydrate) for a sufficient amount of time to boil off and collect said water;

elevating the temperature of the remaining sample to above the boiling of said hydrocarbon based fluid and collecting any additionally released water and boiled off hydrocarbon; and calculating the concentration of said water in said drilling fluid by comparing the amount of boiled off water collected to the amount of boiled off hydrocarbon collected.

13. The method of claim 12 wherein said temperature below the melting point of $MgSO_4 \cdot 7H_2O$ is below substantially 150° C.

14. The method of claim 12 wherein said amount of time is up to substantially two hours.

15. The method of claim 13 wherein said amount of time is substantially 30 to 75 minutes.

16. The method of claim 15 wherein said amount of time is substantially 45 minutes.

* * * * *

UNITED STATES PATENT AND TRADEMARK OFFICE

CERTIFICATE OF CORRECTION

PATENT NO. : 6,216,361 B1
DATED : April 17, 2001
INVENTOR(S) : Smith et al.

It is certified that error appears in the above-identified patent and that said Letters Patent is hereby corrected as shown below:

Column 1,
Line 15, change "position" to -- position, --.
Line 22, change "Ideally" to -- Ideally, --.
Line 36, change "cannot however" to -- cannot, however, --.

Column 4,
Line 5, change "well" to -- well, --.
Line 27, change "($mgSO_4$)" to -- ($MgSO_4$) --.
Line 33, change "$MgsO_4$" to -- $MgSO_4$ --.

Column 5,
Line 1, change "was" to -- were --.
Line 2, change "are" to -- is --.
Line 29, change "PV (mpa-s) to -- PV (mPa-s) --.

Column 6,
Line 33, after "is" insert -- substantially --.
Line 44, delete "substantially".
Lines 58-59, change "is below substantially" to -- is substantially below --.
Line 61, change "is up to substantially" to -- is substantially up to --.

Signed and Sealed this

Fourth Day of December, 2001

*Attest:*

Nicholas P. Godici

NICHOLAS P. GODICI
*Acting Director of the United States Patent and Trademark Office*

*Attesting Officer*